US010562290B2

(12) United States Patent
Zirilli

(10) Patent No.: US 10,562,290 B2
(45) Date of Patent: Feb. 18, 2020

(54) PASSIVE VAPOR DEPOSITION SYSTEM AND METHOD

(71) Applicant: Xerox Corporation, Norwalk, CT (US)

(72) Inventor: Francisco Zirilli, Penfield, NY (US)

(73) Assignee: Xerox Corporation, Norwalk, CT (US)

( * ) Notice: Subject to any disclaimer, the term of this patent is extended or adjusted under 35 U.S.C. 154(b) by 220 days.

(21) Appl. No.: 15/905,080

(22) Filed: Feb. 26, 2018

(65) Prior Publication Data

US 2019/0263108 A1 Aug. 29, 2019

(51) Int. Cl.
*B41F 7/32* (2006.01)

(52) U.S. Cl.
CPC ..... *B41F 7/32* (2013.01); *B41P 2200/22* (2013.01)

(58) Field of Classification Search
None
See application file for complete search history.

(56) References Cited

U.S. PATENT DOCUMENTS 9,387,661 B2 7/2016 Zirilli
2012/0103212 A1 5/2012 Stowe et al.

*Primary Examiner* — Joshua D Zimmerman
(74) *Attorney, Agent, or Firm* — Caesar Rivise, PC

(57) ABSTRACT

A dampening fluid deposition system includes a vapor generator adjacent the air supply channel and in fluid communication with a dampening fluid supply to produce dampening fluid vapor. The vapor generator includes a vapor channel having an interior in communication with air confined within the air supply channel. The vapor generator may include a liquid reservoir receiving dampening fluid from the dampening fluid supply and a heater that heats the received dampening fluid into dampening fluid vapor. The liquid reservoir may include a wick that stores dampening fluid and releases dampening fluid vapor into the vapor channel and a heat conductive tub that holds the wick and dampening fluid. The passive dampening fluid deposition system mixes the dampening fluid vapor with the confined air to form an air/vapor mix that is condensed as a layer of dampening fluid onto the reimageable surface of an imaging member.

20 Claims, 5 Drawing Sheets

PASSIVE VAPOR DEPOSITION SYSTEM AND METHOD

FIELD OF DISCLOSURE

The disclosure relates to ink-based digital printing. In particular, the disclosure relates to printing variable data using an ink-based digital printing system that includes a passive vapor generation system for enhanced dampening fluid delivery.

BACKGROUND

Conventional lithographic printing techniques cannot accommodate true high-speed variable data printing processes in which images to be printed change from impression to impression, for example, as enabled by digital printing systems. The lithography process is often relied upon, however, because it provides very high quality printing due to the quality and color gamut of the inks used. Lithographic inks are also less expensive than other inks, toners, and many other types of printing or marking materials.

Ink-based digital printing as discussed in this disclosure uses a variable data digital lithography printing system, or digital offset printing system. A "variable data digital lithography system" is an image forming system that is configured for lithographic printing using lithographic inks and based on digital image data, which may be variable from one image to the next. "Variable data lithography printing," or "digital ink-based printing," or "digital offset printing" are terms that may be generally interchangeably employed to refer to the processes of lithographic printing of variable image data for producing images on a wide latitude of image receiving media substrates, the images being changeable with each subsequent rendering of an image on a substrate in an image forming process.

For example, a digital offset printing process may include transferring radiation-curable ink onto a portion of a fluorosilicone-containing imaging member surface that has been selectively coated with a dampening fluid layer according to variable image data. The ink is then cured and transferred from the printing plate to a substrate such as paper, plastic, or metal on which an image is being printed. The same portion of the imaging plate may be cleaned and used to make a succeeding image that is different than the preceding image, based on the variable image data. Ink-based digital printing systems are variable data lithography systems configured for digital lithographic printing that may include an imaging member having a reimageable surface layer, such as a silicone-containing surface layer.

Systems may include a dampening fluid metering system for applying dampening fluid to the reimageable surface layer, and an imaging system for laser-patterning the layer of dampening fluid according to image data. The dampening fluid layer is patterned by the imaging system to form a dampening fluid pattern on a surface of the imaging member based on variable data. The imaging member is then inked to form an ink image based on the dampening fluid pattern. The ink image may be partially cured, and is transferred to a printable medium, and the imaged surface of the imaging member from which the ink image is transferred is cleaned for forming a further image that may be different than the initial image, or based on different image data than the image data used to form the first image. Such systems are disclosed in U.S. Publication No. US 2012/0103212A1 ("212 Publication"), entitled "Variable Data Lithography System," filed on Apr. 27, 2011, by Timothy Stowe et al., which is commonly assigned.

Variable data lithographic printing system and process designs must overcome substantial technical challenges to enable high quality, high speed printing. For example, digital architecture printing systems for printing with lithographic inks impose stringent requirements on subsystem materials, such as the surface of the imaging plate, ink used for developing an ink image, and dampening fluid or fountain.

Fountain solutions, otherwise known as dampening fluids, such as octamethylcyclotetrasiloxane "D4" or cyclopentasiloxane "D5" may be applied to the reimageable surface of the imaging member that may be in the form of a printing plate or an intermediate transfer blanket. Subsequently, the applied layer of dampening fluid is image-wise vaporized according to image data to form a latent image in the dampening fluid layer, which may be about 0.5 microns in thickness, for example. During the laser imaging (vaporization) process, the base marking material layer is deposited in a uniform layer, and may spread across the background region, allowing subsequently applied ink to selectively adhere to the image regions. A background region may include D4 between the reimageable surface or plate and the deposited ink. A thickness of the dampening fluid layer may be preferably around 0.2 microns, or more broadly in a range of about 0.05 and about 0.5 microns.

A consistent thickness of a dampening fluid layer formed on the reimageable surface of an imaging member, and inhibiting a variability of the thickness of the disposed layer over the reimageable surface of the imaging member, or over the plate surface, is critical to effective high-quality image printing operations. To obtain a uniform dampening fluid layer thickness, reimageable surface or plate surface conditions must be satisfied. For example, under suitable conditions, a reimageable surface of the imaging member may be characterized by uniform temperature, and concentration of the dampening fluid may be uniform, and a mixture velocity tangential to the reimageable surface of the imaging member or imaging plate motion may be uniform.

SUMMARY

The following presents a simplified summary in order to provide a basic understanding of some aspects of one or more embodiments or examples of the present teachings. This summary is not an extensive overview, nor is it intended to identify key or critical elements of the present teachings, nor to delineate the scope of the disclosure. Rather, its primary purpose is merely to present one or more concepts in simplified form as a prelude to the detailed description presented later. Additional goals and advantages will become more evident in the description of the figures, the detailed description of the disclosure, and the claims.

Systems and methods are provided that enable uniform dampening fluid flow onto a surface of an imaging member or plate. For example, an exemplary passive dampening fluid deposition system is described with an ink-based digital image forming apparatus having a rotating imaging member with a reimageable surface. In examples, the system may include an air supply channel that defines an air supply channel interior in communication with an air source. The air supply channel may descend towards the imaging member and is intentionally constructed to deliver air from the air source towards the reimageable surface of the imaging member. An air supply channel outlet is designed to enable the air supply channel interior to communicate with the reimageable surface of the imaging member. A vapor generation system may be adjacent an air supply channel and in fluid communication with a dampening fluid supply. The vapor generation system may include a vapor channel having a vapor channel outlet, with the vapor channel defining a vapor channel interior in communication with the air in the air supply channel interior from the air source. The vapor generation system is configured to receive dampening fluid from the dampening fluid supply and produce dampening fluid vapor from the received dampening fluid. The vapor generation system may include a generator having a heater and a liquid reservoir, with the liquid reservoir receiving the dampening fluid from the dampening fluid supply. The liquid reservoir may include a wick that stores the dampening fluid and releases the dampening fluid vapor into the vapor channel. The liquid reservoir may also include a heat conductive tub configured to hold the wick and the dampening fluid therein. The heater may be configured to heat the dampening fluid into the dampening fluid vapor. The passive dampening fluid deposition system may then mix the dampening fluid vapor with the air from the air source to form an air/vapor mix. A vapor flow restriction boarder attached to the vapor channel is configured to confine the air/vapor mix to a condensation region to support forming the layer of dampening fluid on the reimageable surface via condensation of the air/vapor mix over the reimageable surface.

According to aspects illustrated herein, a method for depositing an air/vapor mixture onto a reimageable surface of a rotating imaging member may include some combination of steps. The steps may include delivering air from an air source towards the reimageable surface of an imaging member via an air supply channel, the air supply channel defining an air supply channel interior in communication with the air source, the air supply channel descending towards the imaging member, providing an air supply channel outlet adjacent the reimageable surface to enable fluid communication between the air supply channel interior and the reimageable surface of the imaging member, generating dampening fluid vapor by a vapor generation system adjacent the air supply channel and in fluid communication with a dampening fluid supply, the vapor generation system including a vapor channel having a vapor channel outlet, the vapor channel defining a vapor channel interior in communication with the air in the air supply channel interior from the air source, the vapor generation system configured to receive dampening fluid from the dampening fluid supply and produce dampening fluid vapor from the received dampening fluid, mixing the dampening fluid vapor with the air from the air source to form an air/vapor mix, and confining the air/vapor mix to a condensation region adjacent the reimageable surface with a vapor flow restriction boarder attached to the vapor channel, with the confined air/vapor mix condensing to a layer of liquid dampening fluid on the reimageable surface at the condensation region.

The foregoing and/or other aspects and utilities embodied in the present disclosure may be achieved by providing a passive dampening fluid deposition system may include a manifold and vapor generation system that allows the delivery of an air/dampening fluid vapor mixture to a surface of an imaging member, such as a printing rotating plate, with exceptional uniformity in dampening fluid vapor concentration, tangential velocity and temperature to provide a uniform condensate film thickness. The flow may be supplied by a single pipe having a flow stream, or the single pipe may be split equally into two split pipe portions each having a flow stream. The desired flow uniformity may be achieved by maintaining the area ratio of the outlet flow to the inlet flow stream to less than or equal to 0.5. The split tube configuration allows for both split tube diameters to be relatively small compared to a single pipe, while providing exceptional flow uniformity. Dampening fluid vapor is supplied by heating the dampening fluid liquid (e.g., in a wick) that evaporates inside a closed chamber of the vapor generation system. One side of the closed chamber is connected to the air flow stream. Due to low pressure created by the flowing air, the dampening fluid vapor is extracted from the closed chamber and mixes with the air. The air and dampening fluid mixture may be about 150° C. As the mixture is exposed to the cold (e.g., about 40° C.) moving blanket (e.g., reimageable surface of the imaging member), the dampening fluid vapor condenses on the surface of the blanket. Due to the temperature and flow uniformity, the resulting condensate film will also be of uniform thickness.

Exemplary embodiments are described herein. It is envisioned, however, that any system that incorporates features of systems described herein are encompassed by the scope and spirit of the exemplary embodiments.

BRIEF DESCRIPTION OF THE DRAWINGS

Various exemplary embodiments of the disclosed systems, apparatuses, mechanisms and methods will be described, in detail, with reference to the following drawings, in which like referenced numerals designate similar or identical elements, and.

DETAILED DESCRIPTION

Figure 1:
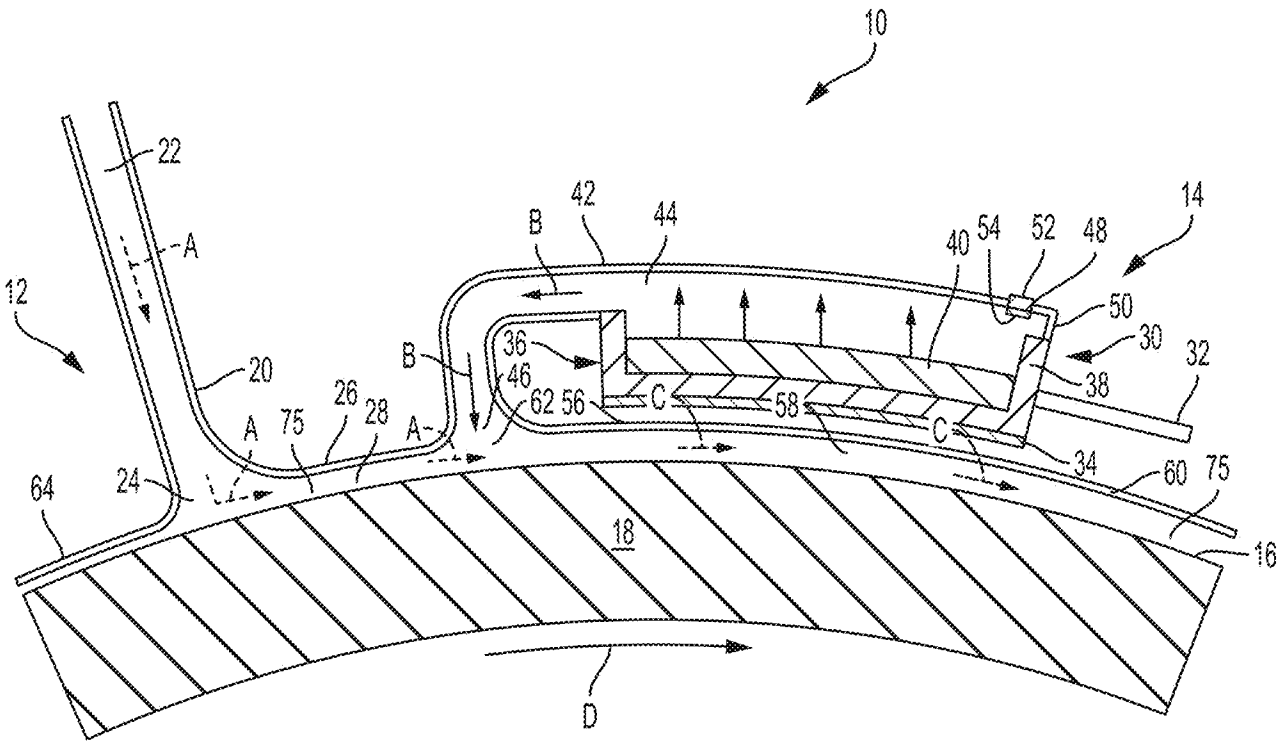
FIG. 1 illustrates a side view, partially in section, of an exemplary passive vapor generation system in accordance with an exemplary embodiment.

Illustrative examples of the devices, systems, and methods disclosed herein are provided below. An embodiment of the devices, systems, and methods may include any one or more, and any combination of, the examples described below. This invention may, however, be embodied in many different forms and should not be construed as limited to the embodiments set forth below. Rather, these exemplary embodiments are provided so that this disclosure will be thorough and complete, and will fully convey the scope of the invention to those skilled in the art. Accordingly, the exemplary embodiments are intended to cover all alternatives, modifications, and equivalents as may be included within the spirit and scope of the apparatuses, mechanisms and methods as described herein.

We initially point out that description of well-known starting materials, processing techniques, components, equipment and other well-known details may merely be summarized or are omitted so as not to unnecessarily obscure the details of the present disclosure. Thus, where details are otherwise well known, we leave it to the application of the present disclosure to suggest or dictate choices relating to those details.

When referring to any numerical range of values herein, such ranges are understood to include each and every number and/or fraction between the stated range minimum and maximum. For example, a range of 0.5-6% would expressly include all intermediate values of 0.6%, 0.7%, and 0.9%, all the way up to and including 5.95%, 5.97%, and 5.99%. The same applies to each other numerical property and/or elemental range set forth herein, unless the context clearly dictates otherwise.

The modifier "about" used in connection with a quantity is inclusive of the stated value and has the meaning dictated by the context (for example, it includes at least the degree of error associated with the measurement of the particular quantity). When used with a specific value, it should also be considered as disclosing that value. For example, the term "about 2" also discloses the value "2" and the range "from about 2 to about 4" also discloses the range "from 2 to 4."

The terms "media", "print media", "print substrate" and "print sheet" generally refers to a usually flexible physical sheet of paper, polymer, Mylar material, plastic, or other suitable physical print media substrate, sheets, webs, etc., for images, whether precut or web fed. The listed terms "media", "print media", "print substrate" and "print sheet" may also include woven fabrics, non-woven fabrics, metal films, and foils, as readily understood by a skilled artisan.

The term "printing device" or "printing system" as used herein may refer to a digital copier or printer, scanner, image printing machine, xerographic device, electrostatographic device, digital production press, document processing system, image reproduction machine, bookmaking machine, facsimile machine, multi-function machine, or generally an apparatus useful in performing a print process or the like and can include several marking engines, feed mechanism, scanning assembly as well as other print media processing units, such as paper feeders, finishers, and the like. A "printing system" may handle sheets, webs, substrates, and the like. A printing system can place marks on any surface, and the like, and is any machine that reads marks on input sheets; or any combination of such machines.

Inking systems or inker subsystems in accordance with embodiments may be incorporated into a digital offset architecture so that the inking system is arranged about a central imaging plate, also referred to as "imaging member". The imaging member may be a cylinder or drum. A surface of the imaging member is reimageable making the imaging member a digital imaging member. The surface is also conformable. The conformable surface may comprise, for example, silicone. A paper path architecture may be situated about the imaging member to form a media transfer nip.

An exemplary passive dampening fluid deposition system is described with an ink-based digital image forming apparatus having a rotating imaging member with a reimageable surface. In examples, the system may include an air supply channel that defines an air supply channel interior in communication with an air source. The air supply channel may descend towards the imaging member and is intentionally constructed to deliver air from the air source towards the reimageable surface of the imaging member. An air supply channel outlet is designed to enable the air supply channel interior to communicate with the reimageable surface of the imaging member.

In examples, a vapor generation system may be adjacent the air supply channel and in fluid communication with a dampening fluid supply. The vapor generation system may include a vapor channel having a vapor channel outlet, with the vapor channel defining a vapor channel interior in communication with the air in the air supply channel interior from the air source. The vapor generation system is configured to receive dampening fluid from the dampening fluid supply and produce dampening fluid vapor from the received dampening fluid. The vapor generation system may include a vapor generator having a heater and a liquid reservoir, with the liquid reservoir receiving the dampening fluid from the dampening fluid supply. The liquid reservoir may include a wick that stores the dampening fluid and releases the dampening fluid vapor into the vapor channel. The liquid reservoir may also include a heat conductive tub configured to hold the wick and the dampening fluid therein. The heater may be configured to heat the dampening fluid into the dampening fluid vapor. An air vent may be inserted into the vapor channel opposite the vapor channel outlet. The air vent may be configured to allow air outside the vapor channel into the vapor channel to enable dampening fluid vapor flow from the air vent through the vapor channel outlet to mix with the air from the air source. The air vent may be filtered to keep unwanted dust and debris out of the system.

The passive dampening fluid deposition system may then mix the dampening fluid vapor with the air from the air source to form an air/vapor mix. A vapor flow restriction boarder attached to the vapor channel is configured to confine the air/vapor mix to a condensation region to support forming the layer of dampening fluid on the reimageable surface via condensation of the air/vapor mix over the reimageable surface. The exemplary dampening fluid deposition systems are referred to as passive because the system does not require any approach to move the dampening fluid vapor other than a vacuum region generated by the air source and rotating imaging member. In addition, no pump may be needed to move the dampening fluid liquid in the reservoir, as the liquid may be introduced into the reservoir by gravity.

In examples, a passive dampening fluid deposition system may include an air supply manifold that includes the air supply channel. The supply manifold may also include a supply chamber. The supply channel may be configured to enable flow of air from the air source to the supply channel. The supply chamber may be formed in a tube shape or a split tube shape, for example. When formed in a split tube shape, the supply chamber may be configured to deliver air from each split tube section into the air supply channel.

Further, the air supply channel may enable low flow impedance and uniform flow distribution, wherein the channel is configured to reduce a flow cross-sectional area at the vapor source location on the imaging member surface. Accordingly, systems may be configured to print at acceptable process speeds, for example, 500 mm/sec to 2000 mm/sec. Moreover, systems may be configured to print at such speeds while running at desired process widths. For example, systems may be configured to include a 1200 DPI laser system while printing at 2000 mm/sec.

FIG. 1 shows a passive dampening fluid deposition system in accordance with an exemplary embodiment. In particular, FIG. 1 shows a dampening fluid deposition system 10 including a manifold 12 and a vapor generation system 14. The vapor generation system 14 is attached to the manifold to produce dampening fluid vapor and provide the vapor to the manifold 12 adjacent a surface 16 of an imaging member 18. The manifold 12 is structured to provide air from an air source (not shown) into mixture with the dampening fluid vapor and deposit the air/dampening fluid mixture as a condensed layer of dampening fluid onto the surface 16. The surface 16 may be a reimageable surface.

The manifold 12 may include a supply channel 20 descending towards and around the imaging member 18. The supply channel 20 may define an interior 22. The interior 22 of the supply channel 20 may enable a flow of gas (e.g., air, vapor) there through to the surface 16 of the imaging member 18 via a supply channel outlet 24 configured to enable the supply channel interior to communicate with the surface 16. As can be seen in FIG. 1, air from the air source may be caused to flow in a direction of arrows A, through the supply channel 20 and adjacent the surface 16. The supply channel 20 may extend to an air flow restriction boarder 26 defining an air flow channel 28 with the surface 16 of the imaging member 18. The air flow restriction boarder 26 is designed to confine the air provided from the supply channel outlet 24 to the air flow channel 28 over the surface 16. The manifold 12 may also include a supply chamber (FIGS. 2-4), which is described in greater detail below.

The vapor generation system 14 may be located adjacent the supply channel 20, and includes a vapor generator 30 in fluid communication with a dampening fluid supply 32. The dampening fluid supply 32 may be shaped like a tube and provide dampening fluid from a dampening fluid source (not shown) to the vapor generator 30. The dampening fluid may be provided through the dampening fluid supply 32 to the vapor generator 30 by gravity or other fluid moving means (e.g., pump).

The vapor generator 30 may include a heater 34 and a liquid reservoir 36 configured to receive the dampening fluid from the dampening fluid supply 32. The liquid reservoir 36 is configured to store the received dampening fluid as heat from the heater 34 heats the dampening fluid into vapor. For example, the liquid reservoir 36 may include a heat conductive material (e.g., aluminum) that may transfer heat from the heater 34 to the dampening fluid in the liquid reservoir to turn the dampening fluid liquid to dampening fluid vapor. The liquid reservoir 36 may be shaped like a tub 38, and may be an aluminum tub. The tub 38 may also include copper, stainless steel or an injection molded temperature resistant plastic. The liquid reservoir 36 may include a wick 40 that holds or stores the received dampening fluid and releases the dampening fluid as heated dampening fluid vapor. The wick 40 may include an absorbent material (e.g., woven fabric, cotton, rayon, wool), and may be a sponge. The wick 40 may also include flat non-absorbent (e.g., Kevlar) strips that are temperature and chemical resistant. The liquid reservoir 36 is not limited to a tub 38 or a wick 40, and may include a combination of both a tub and a wick, as can be seen in FIG. 1. The heater 34 may provide heat to the dampening fluid in the liquid reservoir 36 to heat the dampening fluid into the dampening fluid vapor. While not being limited to any particular construction, the heater 34 may include a heating element (e.g., conductive coil, ribbon, strip of wire) that gives off heat through the process of resistive or Joule heating, as well understood by a skilled artisan.

The vapor generation system 14 may include a vapor channel 42. The vapor channel 42 may define a vapor channel interior 44 in fluid communication with the air from the supply channel 20 flowing in the direction of arrows A from the air source. In particular, the vapor channel 42 may include a vapor channel outlet 46 at an intersection of the vapor channel and the supply channel 20 where air from the supply channel interior 22 and dampening fluid vapor from the vapor channel interior 44 may mix to form an air/vapor mixture.

In order to increase vapor flow to the vapor channel outlet 46, the vapor channel 42 may include an air vent 48 proximate an end 50 of the vapor channel opposite the vapor channel outlet 46. The air vent 48 may be an opening in the vapor channel 42 that is configured to allow ambient air from outside the vapor channel into the vapor channel at the end 50. The addition of this ambient air into the vapor channel may increase dampening fluid vapor flow in the vapor channel through the vapor channel interior 44 in a direction of arrows B and out the vapor channel outlet 48, where the dampening fluid vapor may combine with the air from the supply channel 20 to form the air/vapor mixture. The air vent 48 may include a filter 52 to keep unwanted dust and debris from entering into the vapor generation system 14. The air vent 48 may also include a one-way valve 54 to prevent air or vapor within the vapor channel 42 from flowing out of the channel via the air vent.

Still referring to FIG. 1, the vapor channel 42 may extend to a vapor flow restriction boarder 56 downstream the vapor channel outlet 46 adjacent the surface 16 of the imaging member 18 to confine the air/vapor mixture to a condensation region 58. The vapor flow restriction boarder 56 defines the condensation region 58 over the surface 16 of the imaging member. The vapor flow restriction boarder 56 may include arc walls 60 that face the imaging member surface 16, and boarder walls (not shown) that extend from the arc walls towards the imaging member surface. The condensation region 58 may support the deposition of a layer of dampening fluid on the surface 16 via condensation of the air/vapor mixture onto the surface as the air/vapor mixture may be caused to flow in a direction of arrows C.

The supply channel 20 may also extend upstream the supply channel outlet 24 to an upstream restriction boarder 64 defining an upstream channel 66 with the surface 16 of the imaging member 18. While not being limited to a particular theory, the upstream restriction boarder 64 may be set closer to the surface 16 of the imaging member than the air flow restriction boarder 26 to minimize air from upstream the supply channel outlet 24 into the air flow channel 28 and increase air flow from the supply channel 20 into the air flow channel. A gap between the surface 16 of the imaging member 18 and the upstream restriction boarder 64 may be less than 1 mm.

During operation, dampening fluid vapor is supplied by heating the dampening fluid liquid in the liquid reservoir 36 that evaporates inside the vapor chamber 42 of the vapor generation system 14. The imaging member 18 is rotated as part of a printing process that prints an image onto print media, as well understood by a skilled artisan. The rotation of the imaging member 18 creates a vacuum in the air flow channel 28 and the condensation region 58 between the surface 16 and the restriction boarders 26, 56. This vacuum includes a low pressure region 62 defined by the vapor channel outlet 46, the air flow restriction boarder 26, the vapor flow restriction boarder 56 and the surface 16, where the air from the supply channel interior 22 and the dampening fluid vapor from the vapor channel 42 mix into the air/vapor mixture. Accordingly, due to low pressure created by the flowing air adjacent the rotating imaging member surface 16, the dampening fluid vapor is extracted from the vapor channel 42 and mixes with the air. The air/vapor mixture may be about 150° C. As the mixture is exposed to the cold (e.g., about 40° C.) moving blanket (e.g., reimageable surface 16 of the imaging member), the air/vapor mixture condenses on the surface 16 at the condensation region 58. Due to the temperature and flow uniformity, the resulting condensate film of dampening fluid will also be of uniform thickness, with uniform dampening fluid concentration and mixture velocity.

While not being limited to a particular theory, the manifold 12 and vapor generation system 14 may be made by injection molding, and/or 3D printing, for example. The conduits, channels and boarders of the passive vapor generation system 10 may be made from a combination of materials including Acrylnitride-Butadiene-Stryrene (ABS), Polycarbonate (PC), Polypropylene (PP), Acrylnitride-Butadiene-Stryrene (ABS), Polystyrene (GPPS), Machined aluminum, 3D printed aluminum and other materials that provide the desired structural capabilities as understood by a skilled artisan. The term "boarder" refers to any solid structure shaped to influence a fluid flow.

Figure 2:
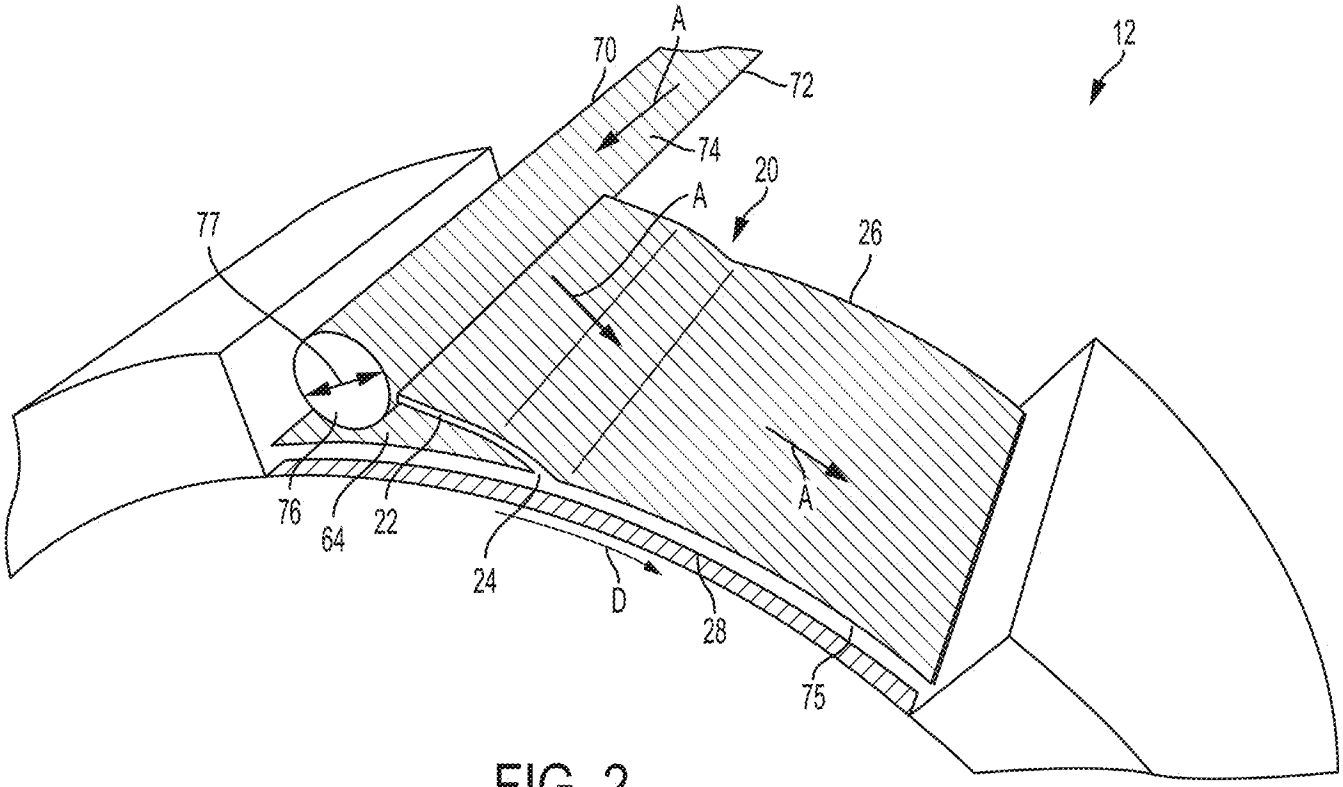
FIG. 2 RELATED ART
FIG. 2 shows a perspective view, partially in section, of a related art dampening fluid deposition subsystem.

FIG. 2 depicts a related art manifold of a related art dampening fluid deposition system 10 disclosed in U.S. Pat. No. 9,387,661 (the '661 patent) that may include a fluid manifold delivery system. The fluid manifold delivery system disclosed in the '661 patent may have an operating supply chamber diameter to printing area surface width ratio of less than 0.8. Mixed air and dampening fluid vapor may be caused to flow through a main supply chamber, and may be discharged onto a 100 mm wide reimageable surface of the imaging member at an angle of less than 30 degrees, for example, with a substantially uniform dampening fluid concentration, a substantially uniform mixture velocity, and a substantially uniform elevated temperature.

As discussed above, the manifold 12 may include the supply channel 20 attached to the vapor generation system 14. The manifold 12 may also include a supply chamber as described in the '661 patent. For example, the supply chamber 70 may be configured in the shape of a tube. The supply chamber 70 may define an interior for containing air suitable for mixture with dampening fluid vapor for ink-based lithographic printing. The supply chamber 70 may include an inlet tube 72 in contact with the air source (not shown) and a tube portion 74 extending to a closed distal end 76 thereof. The supply chamber 70 may be connected to the air source for receiving air in the interior of the supply chamber. The received air may be caused to flow in a direction of arrows A, through the supply chamber 70, to the supply channel 20, and through the supply channel interior 22 for mixture with the dampening fluid vapor at the low pressure region 62.

The surface 16 of the imaging member may include a printing area having a width parallel to the supply channel 20, with the supply channel outlet 24 configured to enable the supply chamber 70 interior to communicate with the surface 16 of the imaging member along the width of the printing area. The width of the printing area is also parallel to the vapor channel 42, with the vapor channel outlet 46 configured to enable the mixing of the received air and dampening fluid vapor for condensation of the air/vapor mixture as the layer (e.g., film) of dampening fluid along the width of the condensation region 58 across the printing area.

Referring to FIGS. 1 and 2, a gap 75 between the surface 16 of the imaging member 18 and the restriction boarders 26, 60 may be 1.735 mm. The gap 75 may be in the range of 1 mm to 3.0 mm, and a gap in the range of 1 mm to 2 mm may be preferred. A diameter 77 of the supply chamber 28 interior may be 20 mm. A width of the supply channel interior 22 may be 1.735 mm to maintain an area ratio of 0.8 with diameter 92 of the supply channel at 20 mm. A width of the printing area shown in FIG. 2 may be about 100 mm.

Figure 3:
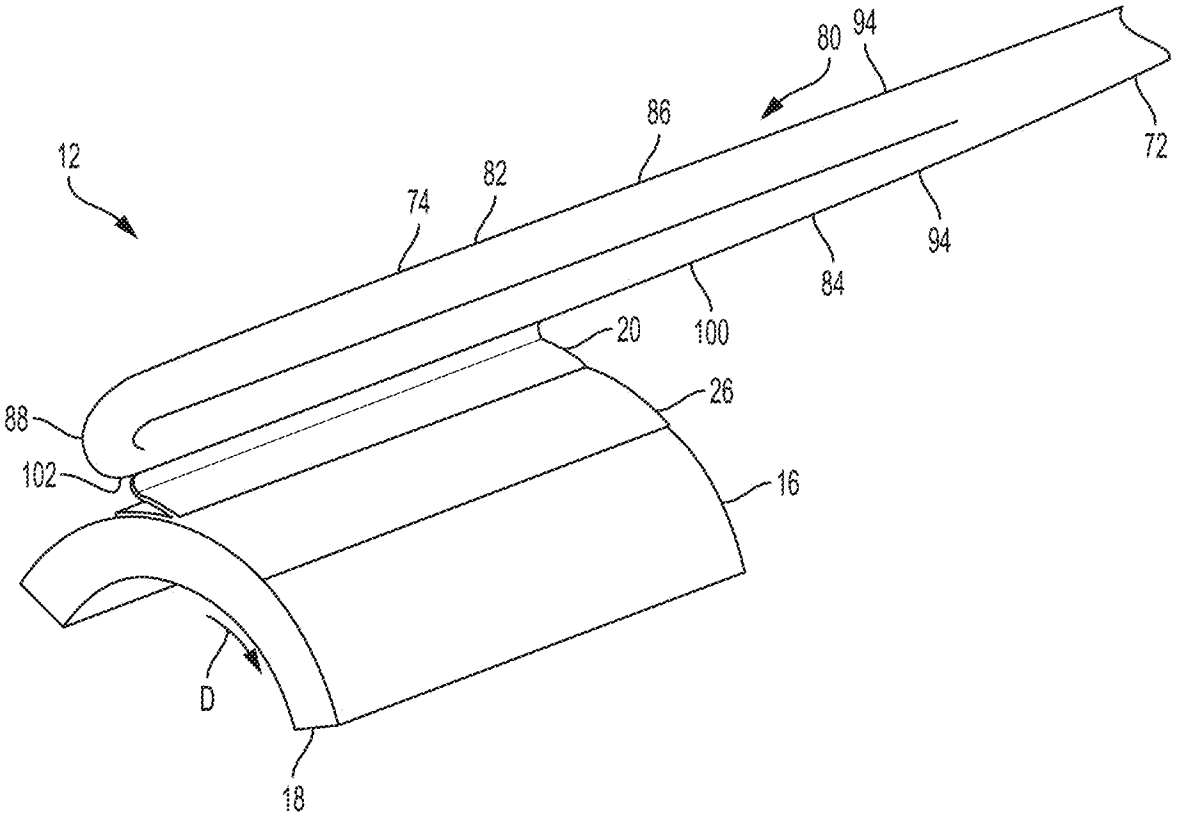
FIG. 3 shows a perspective view of an exemplary dampening fluid deposition subsystem.
Figure 4:
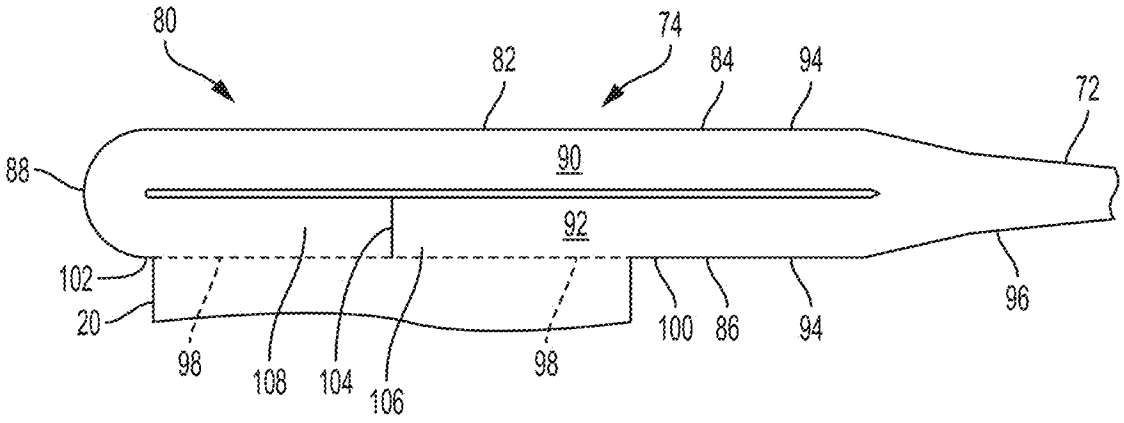
FIG. 4 is a sectional view of the dampening fluid deposition subsystem of FIG. 3.

FIGS. 3 and 4 depict an exemplary manifold 12 of the dampening fluid deposition system 10. The supply chamber 80 shown in FIGS. 3 and 4 is substantially similar to the supply chamber 70 shown in FIG. 2, with the tube portion 74 of the supply chamber 80 having a split tube 82. The split tube 82 may include a first split tube portion 84 and a second split tube portion 86 extending to a closed distal end 88 of the split tube. The tube portion 74 splits into the first and second split tube portions 84, 86 adjacent the inlet tube 72; and the split tube portions rejoin at the closed distal end 88. The first split tube portion 84 defines a first split tube portion interior 90, and the second split tube portion 86 defines a second split tube portion interior 92, the first split tube portion being in fluid communication with the second split tube portion at both the inlet tube 72 and the distal end 88. The first and second split tube portion interiors 90, 92 are in fluid communication with the supply channel interior 22 of the supply channel 20. Thus air flowing through the first and second split tube portion interiors 90, 92 may flow through the supply channel interior 22 for mixture with the dampening fluid vapor at the low pressure region 62 (FIG. 1).

While not being limited to a particular theory, the first and second split tube portion interiors 90, 92 may be configured with the same cross sectional area for flow uniformity between the chambers. Flow uniformity may be achieved by reducing the area ratio between the outlet flow areas of the split tube 82 (e.g., at reference number 94) and the inlet flow area of the inlet tube 72 (e.g., at reference number 96). The first and second split tube portions 84, 86 may provide a low area ratio (e.g., less than half, 0.35 to 0.5) compared to the inlet tube 72 while maintaining a tube diameter smaller than the inlet tube. While not being limited to a particular theory, an area ratio of 0.5 may be preferred for a print width of about 14 inches (355.6 mm). Area ratios of about 0.35 to 0.5, or 0.2 to 0.5 are contemplated with the understanding that as the area ratio decreases the diameter of the supply tubes increase.

Referring to FIG. 4, the second split tube portion 86 is attached to the supply channel 80, and includes an opening 98 between the second split tube portion interior 92 and the interior 22 of the supply channel 20 for fluid communication therebetween. The opening 98 may extend the length of the interior as an elongated slot, or any number of slots sized as desired for the uninterrupted flow of air from the second split tube portion interior 92 and the interior of the supply channel. During operation, air may flow from the inlet tube 72 through the second split tube portion interior 92 into the interior 22 of the supply channel 20 and onto the reimageable surface 16 of the imaging member 18. Air may also flow from the inlet tube 72 through the first split tube portion interior 90 and the second split tube portion interior 92 at the distal end 88 into the interior of the supply chamber and onto the reimageable surface of the imaging member.

The second split tube portion 86 may include a first section 100 proximate the inlet tube 72 and a second section 102 proximate the closed distal end 88. In this example, the first section 100 may extend from the inlet tube to the second section 102, and the second section may extend from the first section to the first split tube portion 84 at the distal end. The first and second sections may connect at an interior wall 104. The interior wall may extend across the second split tube portion interior 92 and separate the second split tube portion interior into two sub-chambers 106 and 108. In this manner, the interior wall 104 is configured to block dampening fluid communication within the second split tube portion interior 92 directly between the sub-chambers 106, 108. The interior wall 94 may help provide air flow uniformity from the split tube 82 to the supply channel 20.

Figure 5:
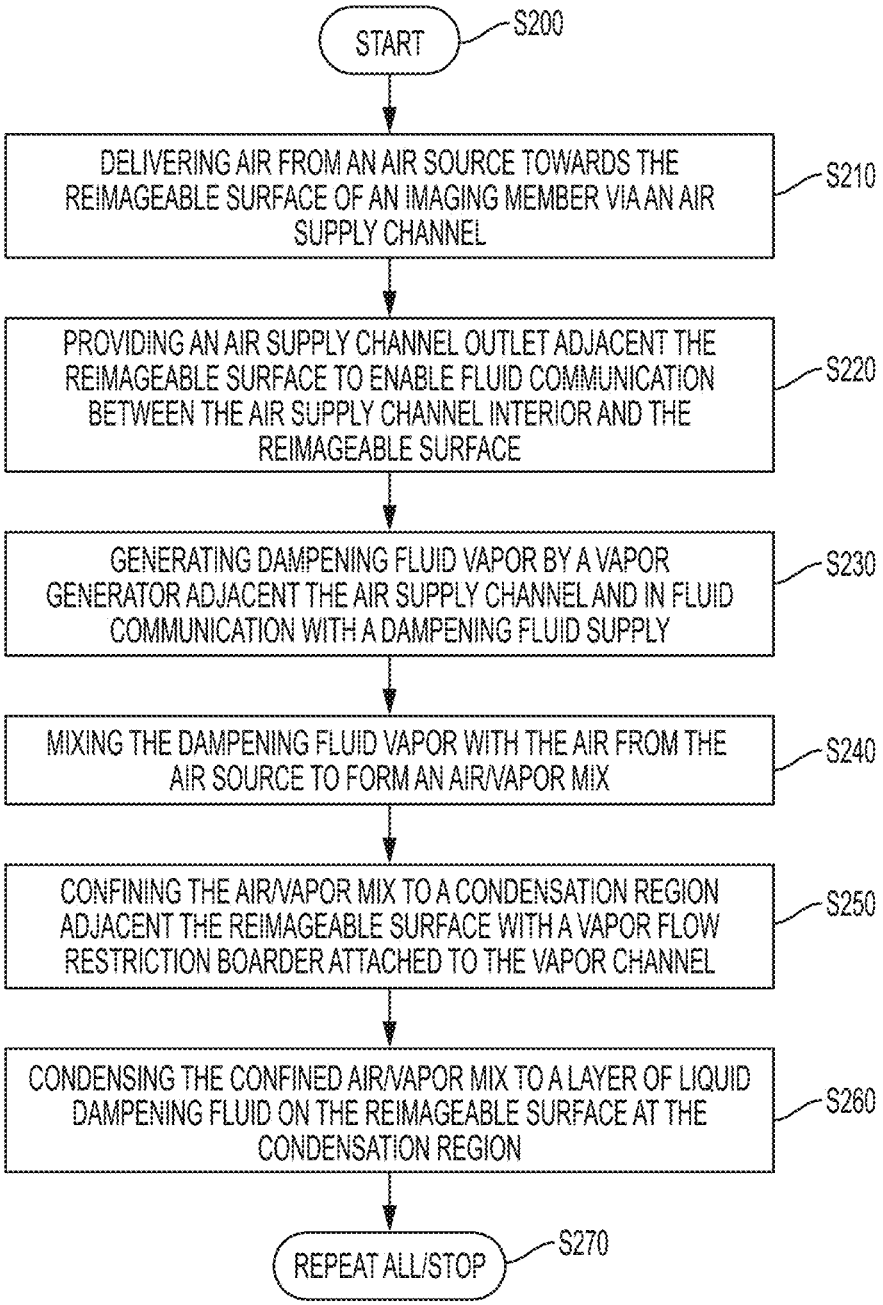
FIG. 5 is a flowchart depicting the operation of an exemplary passive vapor generation system.

Referring to FIGS. 4 and 5, a diameter of the first and second split tube portions 64, 66 may be about 10 mm. The inventor has found that with the split tube 62, the width of the printing area may be widened to over 355.6 mm (14 inches) while maintaining uniform vapor concentration across the width. It has also been found that a width of the printing plate surface may be widened by adjusting manifold dimensions, but maintaining the cross sectional area of the supply channel to the cross sectional area of the tubular supply chamber of about 0.5, of less than 0.5, or of a range from 0.35 to 0.5. Further, it has been found that configurations in accordance with embodiments enable uniform concentration and volume far downstream of the manifold exit during vapor deposition, which enables the condensation region 46 for dampening fluid to form by condensing dampening fluid vapor.

The manifolds 12 discussed by example may be configured in an ink-based digital printing system for depositing dampening fluid on the surface 16 or reimageable printing plate of the imaging member 18. In particular, the interior 22 of the supply channel 20 may be configured to communicate with the surface 16 of the imaging member to deliver air to the surface at an angle of 30 degrees or less, and in the same tangential direction as the rotating imaging member. As the surface 16 of the imaging member rotates in a process direction D, air is caused to flow from the interior of the supply channel 20 to the surface of the imaging member 18. Preferably, a ratio of the cross sectional area of the supply channel 20 to the cross sectional area of the supply chamber 80 is about 0.8. A width of the imaging member surface or printing area may be modified by adjusting the manifold 12 dimensions while maintaining a diameter to width ratio of less than 0.8. Accordingly, systems may be configured for enhanced printing at acceptable process speeds, for example, 500 mm/sec to 2000 mm/sec. Moreover, systems may be configured to print at such speeds while running at desired process widths. For example, systems may be configured to include a 1200 DPI laser system while printing at 2000 mm/sec.

The disclosed embodiments may include an exemplary method that deposits an air/vapor mixture onto a reimageable surface of a rotating imaging member with a passive vapor deposition system. FIG. 5 illustrates a flowchart of such an exemplary method. As shown in FIG. 5, operation of the method commences at Step S200 and proceeds to Step S210.

At Step S210, air from an air source is delivered towards the surface of an imaging member via an air supply channel. The air supply channel defines an air supply channel interior in communication with the air source, and descends towards the imaging member. Step S210 may include allocating air from the air source to the air supply channel via an air supply chamber having an air supply chamber interior. The air supply chamber may include an inlet tube in contact with the air source, and a tube portion extending to a closed distal end thereof. The air supply chamber interior may be defined by the inlet tube and the tube portion. The air flow may be supplied by a single pipe having a flow stream, or the single pipe may be split equally into two split pipe portions each having a flow stream. The desired flow uniformity may be achieved by maintaining the area ratio of the outlet flow to the inlet flow stream to less than or equal to 0.5. The split tube configuration allows for both split tube diameters to be relatively small compared to a single pipe, while providing exceptional flow uniformity. Operation of the method proceeds to Step S220, where fluid communication between the air supply channel interior and the reimageable surface is enabled by an air supply channel outlet provided adjacent the surface of the imaging member.

At Step S230, dampening fluid vapor is generated by a vapor generator adjacent the air supply channel that is in fluid communication with a dampening fluid supply. The vapor generation system may include a closed vapor channel having a vapor channel outlet, with the vapor channel defining a vapor channel interior in communication with the air in the air supply channel interior from the air source. The vapor generation system is configured to receive dampening fluid from the dampening fluid supply and produce dampening fluid vapor from the received dampening fluid. A wick may store the received dampening fluid until the fluid is released as the dampening fluid vapor into the vapor channel. Thus dampening fluid vapor may be generated by heating the dampening fluid liquid (e.g., in the wick), which evaporates inside the vapor chamber. The Step S230 may include heating the received dampening fluid into the dampening fluid vapor with a heater.

Operation of the method proceeds to Step S240, where the dampening fluid vapor is mixed with the air from the air source to form an air/vapor mix. The rotation of the imaging member creates a vacuum in an air flow stream between the surface of the imaging member and the passive vapor deposition system. This vacuum includes a low pressure region defined by the rotating imaging member surface and a combination of the vapor channel outlet and arc walls of the passive vapor deposition system adjacent the imaging member surface. One side of the vapor chamber is connected to the air flow stream. In this low pressure region, the air in the air flow stream and the dampening fluid vapor from the vapor channel mix into the air/vapor mixture. Accordingly, due to low pressure created by the flowing air adjacent the rotating imaging member surface, the dampening fluid vapor is extracted from the vapor channel and mixes with the air. The air and dampening fluid mixture may be about 150° C. Operation of the method may proceed to Steps S250.

At Step S250, the air/vapor mix is confined to a condensation region adjacent the reimageable surface by a vapor flow restriction boarder downstream the vapor channel. At Step S260, the confined air/vapor mix is condensed to a layer of liquid dampening fluid on the reimageable surface at the condensation region. That is, as the air/vapor mix is exposed to the cold (e.g., about 40° C.) moving surface of the imaging member, the air/vapor mix condenses on the surface of the imaging member as a layer of dampening fluid. Operation may cease at Step S270, or may continue by repeating back to Step S210, where more air is delivered from the air source towards the surface of the imaging member via the air supply channel.

The exemplary depicted sequence of executable method steps represents one example of a corresponding sequence of acts for implementing the functions described in the steps. The exemplary depicted steps may be executed in any reasonable order to carry into effect the objectives of the disclosed embodiments. No particular order to the disclosed steps of the method is necessarily implied by the depiction in FIG. 5, and the accompanying description, except where any particular method step is reasonably considered to be a necessary precondition to execution of any other method step. Individual method steps may be carried out in sequence or in parallel in simultaneous or near simultaneous timing. Additionally, not all of the depicted and described method steps need to be included in any particular scheme according to disclosure.

Those skilled in the art will appreciate that other embodiments of the disclosed subject matter may be practiced with many types of image forming elements common to offset inking system in many different configurations. For example, although digital lithographic systems and methods may be shown in the discussed embodiments, the examples may apply to analog image forming systems and methods, including analog offset inking systems and methods. Further, while the discussed imaging member has a reimageable surface, the examples may apply to imageable surfaces that may not be reimageable. It should be understood that these are non-limiting examples of the variations that may be undertaken according to the disclosed schemes. In other words, no particular limiting configuration is to be implied from the above description and the accompanying drawings.

It will be appreciated that the above-disclosed and other features and functions, or alternatives thereof, may be desirably combined into many other different systems or applications. For example, the vapor generation system could attach to the manifold at the supply channel between the supply chamber and the supply channel outlet. Also, various presently unforeseen or unanticipated alternatives, modifications, variations or improvements therein may be subsequently made by those skilled in the art.

What is claimed is:

1. A dampening fluid deposition system useful for printing with an ink-based digital image forming apparatus having a rotating imaging member with a reimageable surface, the system comprising:

an air supply channel defining an air supply channel interior in communication with an air source, the air supply channel descending towards the imaging member, the air supply channel being configured to deliver air from the air source towards the reimageable surface of the imaging member;

an air supply channel outlet configured to enable the air supply channel interior to communicate with the reimageable surface of the imaging member;

a vapor generation system adjacent the air supply channel and in fluid communication with a dampening fluid supply, the vapor generation system including a vapor channel having a vapor channel outlet, the vapor channel defining a vapor channel interior in communication with the air in the air supply channel interior from the air source, the vapor generation system configured to receive dampening fluid from the dampening fluid supply and produce dampening fluid vapor from the received dampening fluid, the dampening fluid deposition system configured to mix the dampening fluid vapor with the air from the air source to form an air/vapor mix; and a vapor flow restriction border attached to the vapor channel and configured to confine the air/vapor mix to a condensation region to support forming the layer of dampening fluid on the reimageable surface via condensation of the air/vapor mix over the reimageable surface.

2. The system of claim 1, the air supply channel including an air flow restriction border defining an air flow channel with the reimageable surface of the imaging member, the air flow restriction border coupled to the vapor channel downstream the air supply channel outlet in a rotating direction of the imaging member to confine the air provided from the air supply channel outlet to an air flow channel over the reimageable surface.

3. The system of claim 1, the vapor generation system including a vapor generator having a heater and a liquid reservoir, the liquid reservoir receiving the dampening fluid from the dampening fluid supply, the heater configured to heat the dampening fluid into the dampening fluid vapor.

4. The system of claim 3, the liquid reservoir including a wick that stores the dampening fluid and releases the dampening fluid vapor into the vapor channel.

5. The system of claim 4, the liquid reservoir further including a heat conductive tub configured to hold the wick and the dampening fluid therein.

6. The system of claim 1, the vapor channel including an air vent at an end of the vapor channel opposite the vapor channel outlet, the air vent configured to allow air outside the vapor channel into the vapor channel to enable dampening fluid vapor flow from the air vent through the vapor channel outlet to mix with the air from the air source.

7. The system of claim 1, further comprising an air supply chamber having an air supply chamber interior, the air supply chamber including an inlet tube in contact with the air source and a tube portion extending to a closed distal end thereof, the air supply chamber interior defined by the inlet tube and the tube portion.

8. The system of claim 7, the tube portion having a first split tube portion and a second split tube portion extending to the closed distal end of the split tube, with the first and second split tube portions joining at the closed distal end, the first split tube portion defining a first split tube portion interior, the second split tube portion defining a second split tube portion interior, the first split tube portion interior being in fluid communication with the second split tube portion interior at both the inlet tube and the distal end.

9. The system of claim 8, the air supply channel being configured to deliver air from both the first split tube portion and the second split tube portion onto the reimageable surface of the imaging member.

10. The system of claim 9, the second split tube portion including a first section proximate the inlet tube, a second section proximate the closed distal end, and an interior wall between the first and second sections, the interior wall extending across the second split tube portion interior, the interior wall configured to block air communication within the second split tube portion interior between the first section and the second section.

11. A method for depositing an air/vapor mixture onto a reimageable surface of a rotating imaging member useful for printing with an ink-based digital image forming apparatus, comprising:

delivering air from an air source towards the reimageable surface of an imaging member via an air supply channel, the air supply channel defining an air supply channel interior in communication with the air source, the air supply channel descending towards the imaging member;

providing an air supply channel outlet adjacent the reimageable surface to enable fluid communication between the air supply channel interior and the reimageable surface of the imaging member;

generating dampening fluid vapor by a vapor generation system adjacent the air supply channel and in fluid communication with a dampening fluid supply, the vapor generation system including a vapor channel having a vapor channel outlet, the vapor channel defining a vapor channel interior in communication with the air in the air supply channel interior from the air source, the vapor generation system configured to receive dampening fluid from the dampening fluid supply and produce dampening fluid vapor from the received dampening fluid;

mixing the dampening fluid vapor with the air from the air source to form an air/vapor mix; and confining the air/vapor mix to a condensation region adjacent the reimageable surface with a vapor flow restriction border attached to the vapor channel, the confined air/vapor mix condensing to a layer of liquid dampening fluid on the reimageable surface at the condensation region.

12. The method of claim 11, the step of generating dampening fluid vapor including heating the received dampening fluid into the dampening fluid vapor with a heater of the vapor generation system.

13. The method of claim 12, further comprising storing the received dampening fluid with a wick that releases the heated dampening fluid vapor into the vapor channel.

14. The method of claim 11, the step of delivering air from an air source towards the reimageable surface of an imaging member via an air supply channel including allocating air from the air source to the air supply channel via an air supply chamber having an air supply chamber interior, the air supply chamber including an inlet tube in contact with the air source and a tube portion extending to a closed distal end thereof, the air supply chamber interior defined by the inlet tube and the tube portion.

15. A dampening fluid deposition system useful for printing with an ink-based digital image forming apparatus having a rotating imaging member with a reimageable surface, the system comprising:

an air supply channel defining an air supply channel interior in communication with an air source, the air supply channel descending towards the imaging member, the air supply channel being configured to deliver air from the air source towards the reimageable surface of the imaging member;

an air supply channel outlet configured to enable the air supply channel interior to communicate with the reimageable surface of the imaging member;

an air flow restriction border defining an air flow channel with the reimageable surface of the imaging member, the air flow restriction border configured to confine the air provided from the air supply channel outlet to an air flow channel over the reimageable surface;

a vapor generation system adjacent the air supply channel and in fluid communication with a dampening fluid supply, the vapor generation system including a vapor channel having a vapor channel outlet, the vapor channel coupled to the air flow restriction border downstream the air supply channel in a rotating direction of the imaging member, the vapor channel defining a vapor channel interior in communication with the air in the air supply channel interior from the air source, the vapor generation system configured to receive dampening fluid from the dampening fluid supply and produce dampening fluid vapor from the received dampening fluid;

a vapor flow restriction border attached to the vapor channel and defining a condensation region with the reimageable surface of the imaging member; and a low pressure region defined by the vapor channel, the air flow restriction border, the vapor flow restriction boarder and the imaging member, wherein the dampening fluid vapor is mixed with the air from the air source to form an air/vapor mix, and the vapor flow restriction border is configured to confine the air/vapor mix to the condensation region to support forming the layer of dampening fluid on the reimageable surface via condensation of the air/vapor mix over the reimageable surface.

16. The system of claim 15, the vapor generation system including a vapor generator having a heater and a liquid reservoir, the liquid reservoir receiving the dampening fluid from the dampening fluid supply, the heater configured to heat the dampening fluid into the dampening fluid vapor.

17. The system of claim 16, the liquid reservoir including a wick that stores the dampening fluid and releases the dampening fluid vapor into the vapor channel, the liquid reservoir further including a heat conductive tub configured to hold the wick and the dampening fluid therein.

18. The system of claim 15, the vapor channel including an air vent at an end of the vapor channel opposite the vapor channel outlet, the air vent configured to allow air outside the vapor channel into the vapor channel to enable dampening fluid vapor flow from the air vent through the vapor channel outlet to mix with the air from the air source.

19. The system of claim 15, further comprising an air supply chamber having an air supply chamber interior, the air supply chamber including an inlet tube in contact with the air source and a tube portion extending to a closed distal end thereof, the air supply chamber interior defined by the inlet tube and the tube portion.

20. The system of claim 19, the tube portion having a first split tube portion and a second split tube portion extending to the closed distal end of the split tube, with the first and second split tube portions joining at the closed distal end, the first split tube portion defining a first split tube portion interior, the second split tube portion defining a second split tube portion interior, the first split tube portion interior being in fluid communication with the second split tube portion interior at both the inlet tube and the distal end, the air supply channel being configured to deliver air from both the first split tube portion and the second split tube portion onto the reimageable surface of the imaging member, the second split tube portion including a first section proximate the inlet tube, a second section proximate the closed distal end, and an interior wall between the first and second sections, the interior wall extending across the second split tube portion interior, the interior wall configured to block air communication within the second split tube portion interior between the first section and the second section.

* * * * *